US010111501B2

(12) United States Patent
Script

(10) Patent No.: US 10,111,501 B2
(45) Date of Patent: Oct. 30, 2018

(54) SELF-BINDING STRAP DEVICE AND METHOD FOR USING SAME

(71) Applicant: Michael Script, Fairfax, VA (US)

(72) Inventor: Michael Script, Fairfax, VA (US)

( * ) Notice: Subject to any disclaimer, the term of this patent is extended or adjusted under 35 U.S.C. 154(b) by 225 days.

(21) Appl. No.: 14/970,806

(22) Filed: Dec. 16, 2015

(65) Prior Publication Data

US 2016/0174668 A1 Jun. 23, 2016

Related U.S. Application Data

(60) Provisional application No. 62/093,171, filed on Dec. 17, 2014.

(51) Int. Cl.
*A44B 18/00* (2006.01)

(52) U.S. Cl.
CPC ..... *A44B 18/0084* (2013.01)

(58) Field of Classification Search
CPC ..... A44B 18/0084
See application file for complete search history.

(56) References Cited

U.S. PATENT DOCUMENTS

| | | | | |
|---|---|---|---|---|
| 3,009,235 | A | 11/1961 | De Mestral | |
| 6,588,074 | B2 | 7/2003 | Galkiewicz et al. | |
| 7,331,087 | B2 * | 2/2008 | Lindsay | A44B 18/0015 24/442 |
| 2002/0169435 | A1 * | 11/2002 | Neeb | A61F 13/15658 604/385.101 |
| 2013/0044215 | A1 | 2/2013 | Rothkopf et al. | |
| 2014/0274614 | A1 * | 9/2014 | Newman | A63B 21/4035 482/139 |
| 2015/0156905 | A1 * | 6/2015 | Blochlinger | F16F 1/027 206/736 |

* cited by examiner

*Primary Examiner* — Robert Sandy
*Assistant Examiner* — Matthew J Sullivan

(57) ABSTRACT

A bi-stable spring band device that is covered substantially along its entire length with Velcro® or similar fastening material, where one side of the device is covered substantially along its length with Velcro® "hook" material and the opposing side of the device is covered substantially along its length with corresponding Velcro® "loop" material. When the device is curled into a rolled-up configuration by application of the bi-stable band, its opposing Velcro® "hook" and "loop" surfaces can fasten together to form a secure strap that is strong enough to hold weighted articles in the air or to securely connect one article to another.

10 Claims, 2 Drawing Sheets

SELF-BINDING STRAP DEVICE AND METHOD FOR USING SAME

CROSS-REFERENCE TO RELATED APPLICATIONS

This application claims priority under 35 U.S.C. § 119(e) to U.S. Provisional Patent Application No. 62/093,171, entitled "Snap, Wrap, and Lock Apparatus," filed Dec. 17, 2014.

FIELD OF THE INVENTION

Embodiments of the present invention relate to a separable self-binding strap device and corresponding methods for using it. More particularly, embodiments of the present invention relate to a "Slap Wrap" or similar bi-stable band device that is covered substantially along its entire length with Velcro® or similar fastening material, where one side of the device is covered with Velcro® "hook" material and the opposing side of the device is covered with Velcro "loop" material.

BACKGROUND

While performing routine construction, maintenance, and other related activities, it is often useful to quickly hang a heavy item such as a paint-can or electric saw to a nearby hook or rod for easy access. In farming or animal husbandry, it is often useful to quickly secure a farm animal to a post with a leash. In other activities, it can be useful to quickly secure a coil of wire for spooling, to bind temporary fencing materials across a median to prevent breaching, to secure various pieces of luggage together, and the like.

Conventional solutions to these problems often involve using ropes that require tying, wires that must be twisted and cut, cable ties that can be used only once, and similar devices that are either relatively difficult to use or configure (for example, requiring two hands or tools), or are single-use-only and therefore are not cost effective or are potentially wasteful and/or harmful to the environment. A securing device that can be quickly installed, quickly removed, and reused repeatedly is desired.

SUMMARY OF THE INVENTION

This summary is provided to introduce certain concepts in a simplified form that are further described below in the Detailed Description. This summary is not intended to identify key features or essential features of the claimed subject matter, nor is it intended to limit in any way the scope of the claimed invention.

Embodiments of the present invention are directed to providing a bi-stable spring band device that is covered substantially along its entire length with Velcro® or similar fastening material, where one side of the device is covered substantially along its length with Velcro® "hook" material and the opposing side of the device is covered substantially along its length with corresponding Velcro® "loop" material. When the device is curled into a rolled-up configuration by application of the bi-stable band, its opposing Velcro® "hook" and "loop" surfaces can fasten together to form a secure loop or strap that is strong enough to hold weighted articles or to securely connect one article to another.

Some known strapping systems use a Velcro® fastening material for binding but lack a bi-stable spring band to produce a self-wrapping action. Other known systems use bi-stable spring bands to provide a self-wrapping action, hut they provide no sustainable high-resistance binding properties. Still other known strapping devices use a bi-stable spring band with a fastening material, but by design, these devices affix the fastening material to only a small section of the bi-stable spring band, and only for the purpose of lightly securing the fastening material to itself, not for supporting a weight or to securely connect one article to another.

The above summaries of embodiments of the present invention have been provided to introduce certain concepts that are further described below in the Detailed Description. The summarized embodiments are not necessarily representative of the claimed subject matter, nor do they span the scope of features described in more detail below. They simply serve as an introduction to the subject matter of the various inventions.

BRIEF DESCRIPTION OF THE DRAWINGS

So the manner in which the above recited summary features of the present invention can be understood in detail, a more particular description of the invention may be had by reference to embodiments, some of which are illustrated in the appended drawings. It is to be noted, however, that the appended drawings illustrate only example embodiments of this invention and are therefore not to be considered limiting of its scope, for the invention may admit to other equally effective embodiments.

DESCRIPTION OF THE EMBODIMENTS

Figure 1:
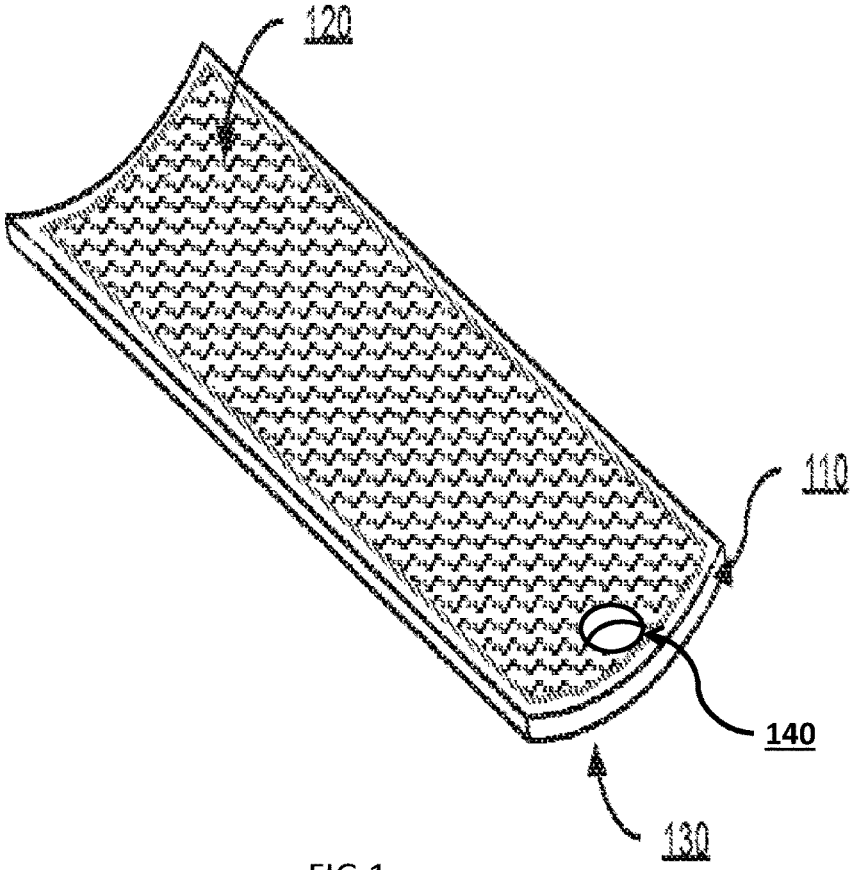
FIG. 1 illustrates an exemplary embodiment of a separable self-binding strap device, in accordance with the present disclosure.

Embodiments of the present invention will be described with reference to the accompanying drawings, wherein like parts are designated by like reference numerals throughout, and wherein the leftmost digit of each reference number refers to the drawing number of the figure in which the referenced part first appears.

As summarized above, embodiments of the present invention provide a novel Velcro®-covered bi-stable band device for quickly creating a securely bound loop or strap from which a heavy article (such as a paint-can or an electric saw) can be hung from a hook or rod or similar attachment point, or with which two articles (such as an animal leash and a post, or two pieces of luggage) can be securely connected to each other. Embodiments of the invention can be quickly installed, quickly removed, and reused repeatedly as desired.

Referring now to FIG. 1, an exemplary embodiment of a separable self-binding strap device 100 is illustrated, in accordance with the present disclosure. The separable self-binding strap 100 may comprise a bi-stable spring band 110 that is substantially covered on one side 120 with a Velcro® "hook" (or "loop") material or other similar fastening material, and is also substantially covered on the opposite side 130 with a corresponding Velcro® "loop" (or "hook") material or other similar fastening material.

The bi-stable spring band 110 may comprise a flexible bi-stable spring band that may assume two equilibrium positions. In a first equilibrium position, the bi-stable spring band 110 may be substantially flat with a slight curve about its lengthwise axis, as shown in FIG. 1. To reach a second equilibrium position, the bi-stable hand 110 may be slapped across a roughly circular object, such as a rod, bar, dowel, post, wrist, ankle, arm, leg, handle, or other similar attachment point at which point the bi-stable spring band 110 may spontaneously transition from the first equilibrium position to the second equilibrium position, and thereby curl around the roughly circular object to remain relatively secure in that position.

The bi-stable spring band 110 may be made of stainless steel, plastic, vinyl, or other suitable material and may be optionally sealed within a fabric, silicone, plastic, or other suitable cover.

As shown in FIG. 1, the separable self-binding strap 100 may comprise a bi-stable spring hand 110 that is substantially covered on one side with a Velcro® "hook" material 120 or other similar fastening material, and is also substantially covered on the opposite side with a corresponding Velcro® "loop" material 130 or other similar fastening material. In one embodiment, the Velcro® or other fastening material may be configured as a sleeve that contains and holds the bi-stable spring band 110. In another embodiment, the Velcro® or other fastening material may be attached directly to the bi-stable spring band 110 by any suitable means known in the art, including glue or other forms of RF, chemical, or adhesive bonding, and/or riveting or other forms of mechanical or physical bonding. When attached directly to the bi-stable spring band 110, the "loop" component of Velcro® or other fastening material may be attached to one side of the bi-stable spring band 110 and the "hook" component of Velcro® or other fastening material may be attached to the other side of the bi-stable spring band 110.

When the Velcro® or other fastening material is configured as a sleeve to contain and hold the bi-stable spring band 110, the sleeve may comprise two opposing Velcro® components (that is, a "hook" component and a "loop" component) that are placed back to back. In other words, the non-hook side of the "hook" Velcro® component may be placed against the non-loop side of the "loop" Velcro® component. The two components are then bonded together along three edges (typically two sides and one end), leaving one end open for insertion of the bi-stable spring band 110. After the bi-stable spring band 110 is inserted into the open end of the sleeve, the open end can be bonded, thereby enclosing the bi-stable spring band 110 within the sleeve and completing assembly the separable self-binding strap 100. Optionally, the bi-stable spring band 110 may be bonded to the inner surfaces of the sleeve by any suitable means known in the art. The process for bonding the edges of the sleeve together can involved the use of heat, stitching, glue, riveting, RE heat-sealing, or any other means known in the art.

Either end of the separable self-binding strap 100 may be configured with any one or combination of the following affixing mechanisms: a hook, a clamp, an eye, an eyelet 140, a nail or any other affixing means suitable to secure the separable self-binding strap 100 to a fixed foundation such as a piece of wood, beam, pipe, wire, or other attachment point commonly found in homes, apartments, construction sites, vehicles, and spacecraft, for example.

Figure 2:
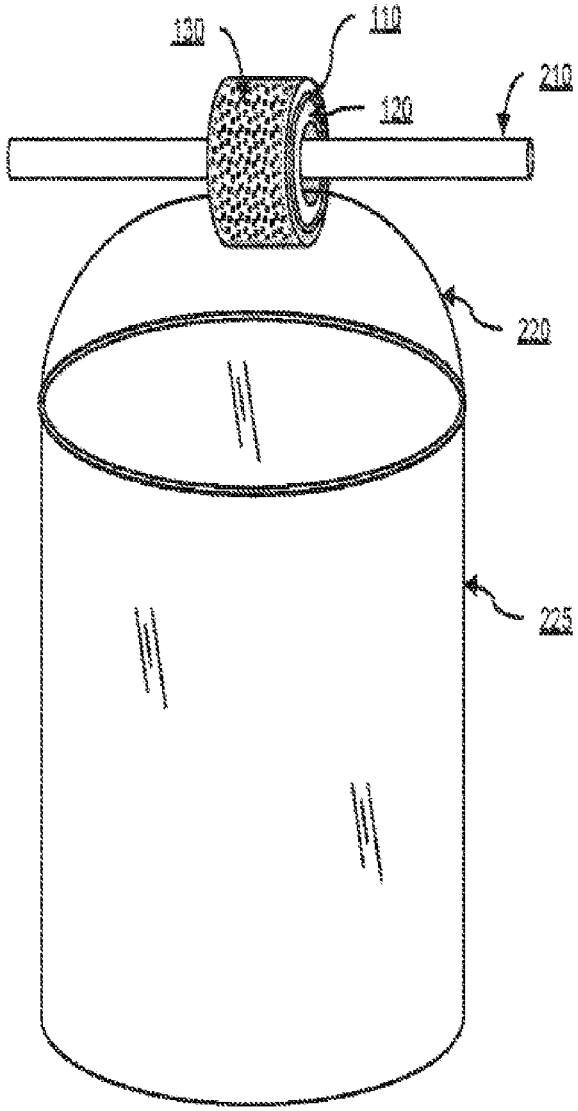
FIG. 2 illustrates an exemplary embodiment of a separable self-binding strap device in operation, in accordance with the present disclosure.

FIG. 2 illustrates an exemplary embodiment of a separable self-binding strap device in operation, in accordance with the present disclosure. As shown in FIG. 2, an embodiment of a separable self-binding strap 100 has been "slapped" across two roughly cylindrical objects that are held close to each other. In FIG. 2, these roughly cylindrical objects are shown as a rod or dowel 210 and a paint-can handle 220. Other examples of roughly cylindrical objects may include, for example, a ladder run, a post, a wrist, an ankle, an arm, a leg, a handle, or other similar structure. When a flat and straight separable self-binding strap 100 is "slapped" across the dowel 210 and the paint-can handle 220, the bi-stable spring band 110 may spontaneously transition from the first equilibrium position to the second equilibrium position and thereby quickly curl or coil around both the dowel 210 and the paint-can handle 220 to hold them relatively securely together, to enable the paint can 225 or other weighted article to be hung from the dowel 210. During the curling action of the bi-stable spring band 110, the opposing surfaces of the cooperating Velcro® components (120 and 130) will come in contact with each other, which will cause their cooperating "hook" and "loop" Velcro® components to join together, compressing hook against loop, to create a strong bond capable of resisting a force of at least 50 pounds.

The separable self-binding strap 100 is separable because the interlocking Velcro® components can be separated from each other, so the separable self-binding strap 100 can be returned to the first equilibrium position and reused in a later application. Normally, separation of the Velcro® components (120 and 130) will require a force of a considerable magnitude when a large number of hooks are engaged with corresponding loops, but separation may be quite readily affected by progressively uncurling the separable self-binding strap 100, thereby peeling the cooperating "hook" 120 and "loop" 130 Velcro® components apart. Unwrapping the separable self-binding strap 100 by an exterior end of the elongated bi-stable spring band 110 can increase the tension across the bi-stable spring band 110 until the coil is fully unwrapped and the curvature tension is applied as the bi-stable spring band 110 is elongated.

Thus, continuing to refer to FIG. 2, embodiments of a separable self-binding strap 100 can he employed to quickly hang a weighted article (for example, paint can 225) from a hook, loop, rod, bar, flange, or other similar attachment point (for example, dowel 210), or to securely connect at least two articles together, by action of the curling and wrapping feature of the bi-stable spring band 110 together with the interlocking principles of the Velcro® or other similar fastening material disposed along the full length of the bi-stable spring hand 110. For example, embodiments of a separable self-binding strap 100 can be employed: (1) to secure a paint can to a ladder rung, (2) to securely strap an electric saw by the handle to a construction beam, (3) to bind copper tubing to a secured pipe for easy access, (4) to strap a farm animal with a leash to a post, (5) to permanently or temporarily secure coiled wire for easy spooling, (6) to secure temporary fencing across a median to prevent breaching, or (7) to secure various pieces of luggage together.

In one embodiment, the separable self-binding strap 100 may range from approximately 0.5 to 2 inches in width, and may range from approximately 3 to 12 inches in length. Other widths and lengths are possible and within the scope of the invention, based on the intended use and anticipated amount of resistance required.

FIG. 2 illustrates the use of one separable self-binding strap 100, but more than one embodiments of the invention can be used together, serially, or in parallel.

Although the present disclosure provides certain embodiments and applications, other embodiments apparent to those of ordinary skill in the art, including embodiments that do not provide all of the features and advantages set forth herein, are also within the scope of this disclosure.

The foregoing disclosure has been set forth merely to illustrate the invention and is not intended to be limiting. It will be appreciated that modifications, variations and additional embodiments are covered b the above teachings and within the purview of the appended claims without departing from the spirit and intended scope of the invention. Since modifications of the disclosed embodiments incorporating the spirit and substance of the invention may occur to persons skilled in the art, the invention should be construed to include everything within the scope of the appended claims and equivalents thereof.

The invention claimed is:

1. A separable self-wrapping strap device comprising:

an upper layer of hook material in attachment with a lower layer of loop material to form a cavity there-between, which is substantially closed along its edges;

an eyelet affixed to at least one end of the separable self-wrapping strap device, further securing the upper layer of hook material to the lower layer of loop material;

a bi-stable spring band positioned within the cavity, wherein the bi-stable spring band is configured to alternate the shape of the separable self-wrapping strap device between a substantially flat, straight configuration and a substantially coiled, wrapped configuration;

wherein the wrapped configuration, a substantial portion of the upper layer of hook material is pressed against a substantial portion of the lower layer of loop material by coiling action of the bi-stable band, such that in the wrapped configuration, the separable self-wrapping strap device forms a substantially closed loop capable of resisting a weighted force of at least 50 pounds.

2. The separable self-wrapping strap device of claim 1, wherein the bi-stable band is bonded to the inner surfaces of the cavity.

3. The separable self-wrapping strap device of claim 2, wherein the bonding is achieved by application of adhesive action.

4. The separable self-wrapping strap device of claim 3, wherein the adhesive action comprises RF heat-sealing.

5. The separable self-wrapping strap device of claim 3, wherein the adhesive action comprises glue.

6. The separable self-wrapping strap device of claim 1, wherein the eyelet extends through the bi-stable band in addition to the upper layer of hook material and the lower layer of loop material.

7. The separable self-wrapping strap device of claim 1, wherein the bi-stable spring band is configured to alternate from the substantially flat, straight configuration to the substantially coiled, wrapped configuration in response to the self-wrapping strap device being slapped against a curved object.

8. The separable self-wrapping strap device of claim 1, wherein the self-wrapping strap device is configured to be unwrapped by peeling the upper layer of hook material away from the lower layer of loop material.

9. A separable self-wrapping strap device comprising:

a bi-stable spring band configured to alternate between a substantially flat, straight configuration and a substantially coiled, wrapped configuration;

an upper layer of hook material substantially covering and affixed to a top side of the bi-stable spring band;

a lower layer of loop material substantially covering and affixed to an under side of the bi-stable spring band;

an eyelet affixed to at least one end of the separable self-wrapping strap device, further securing the upper layer of hook material to the lower layer of loop material;

wherein the wrapped configuration, a substantial portion of the upper layer of hook material is pressed against a substantial portion of the lower layer of loop material by coiling action of the bi-stable band, such that in the wrapped configuration, the separable self-wrapping strap device forms a substantially closed loop capable of resisting a weighted force of at least 50 pounds.

10. A method of securing a weighted object to a horizontal bar comprising:

holding a handle of a weighted object substantially close to the horizontal bar; and slapping a separable self-wrapping strap device around the horizontal bar and the handle of the weighted object to secure the weighted object to the horizontal bar;

the separable self-wrapping strap device comprising: (1) a bi-stable spring band configured to alternate between a substantially flat, straight configuration and a substantially coiled, wrapped configuration; (2) an upper layer of hook material substantially covering and affixed to one side of the bi-stable spring band; (3) a lower layer of loop material substantially covering and affixed to an opposing side of the bi-stable spring band; and (4) an eyelet affixed to at least one end of the separable self-wrapping strap device, further securing the upper layer of hook material to the lower layer of loop material; and wherein when the separable self-wrapping strap device is slapped around the horizontal bar and the handle of the weighted object, it transitions from the substantially flat, straight configuration to the substantially coiled, wrapped configuration, wherein a substantial portion of the upper layer of hook material becomes pressed against a substantial portion of the lower layer of loop material by coiling action of the bi-stable band, such that in the wrapped configuration, the separable self-wrapping strap device forms a substantially closed loop capable of securing the weighted object to the horizontal bar.

* * * * *